US007984955B2

(12) United States Patent
Jung et al.

(10) Patent No.: US 7,984,955 B2
(45) Date of Patent: Jul. 26, 2011

(54) REFRIGERATOR DOOR OPENING DEVICE AND REFRIGERATOR HAVING THE SAME

(75) Inventors: Sang Gyu Jung, Gwangju (KR); Yun Ho Yang, Yongin-si (KR); Ju Saeng Kim, Seoul (KR); Joo Hyung Kim, Seoul (KR); Yoon Jung Choi, Seoul (KR)

(73) Assignee: Samsung Electronics Co., Ltd, Suwon-Si (KR)

( * ) Notice: Subject to any disclaimer, the term of this patent is extended or adjusted under 35 U.S.C. 154(b) by 28 days.

(21) Appl. No.: 12/585,298

(22) Filed: Sep. 10, 2009

(65) Prior Publication Data

US 2010/0101267 A1 Apr. 29, 2010

(30) Foreign Application Priority Data

Oct. 28, 2008 (KR) ..... 10-2008-0105965

(51) Int. Cl.
*A47B 96/04* (2006.01)

(52) U.S. Cl. ..... 312/405; 312/319.2; 312/332.1; 16/412

(58) Field of Classification Search ..... 312/404, 312/405, 405.1, 319.1–319.2, 326–329, 332.1; 62/265, 449, 440; 16/412; 49/263, 272–274
See application file for complete search history.

(56) References Cited

U.S. PATENT DOCUMENTS

| | | | | |
|---|---|---|---|---|
| 2,659,115 | A * | 11/1953 | Anderson et al. | 49/277 |
| 2,889,787 | A * | 6/1959 | Schell | 109/63.5 |
| 5,908,228 | A * | 6/1999 | Lee | 312/405 |
| 5,915,805 | A * | 6/1999 | Lee | 312/405 |
| 6,375,291 | B1 * | 4/2002 | Nam et al. | 312/405 |
| 6,655,765 | B2 * | 12/2003 | Kawamura et al. | 312/405 |
| 6,997,527 | B2 * | 2/2006 | Cheng | 312/332.1 |
| 7,104,621 | B2 * | 9/2006 | Choi | 312/405 |
| 7,195,293 | B2 * | 3/2007 | Ala | 292/254 |
| 7,765,645 | B2 * | 8/2010 | Kim | 16/412 |
| 2006/0043852 | A1 * | 3/2006 | Kwon | 312/405 |
| 2006/0103278 | A1 * | 5/2006 | Bousquet | 312/332.1 |
| 2008/0282505 | A1 * | 11/2008 | Kim | 16/412 |

FOREIGN PATENT DOCUMENTS

| | | |
|---|---|---|
| EP | 1 174 668 | 1/2002 |
| KR | 20-1999-0020194 | 6/1999 |
| KR | 10-2001-0072250 | 7/2001 |

* cited by examiner

*Primary Examiner* — Hanh V Tran
(74) *Attorney, Agent, or Firm* — Staas & Halsey LLP

(57) ABSTRACT

A refrigerator including a door opening device mounted in a grip part defined in any one of an upper surface and lower surface of a door and a side surface of the door opposite to a hinge shaft of the door. The door opening device is covered with a shield provided at a front surface of the door.

16 Claims, 14 Drawing Sheets

REFRIGERATOR DOOR OPENING DEVICE AND REFRIGERATOR HAVING THE SAME

CROSS-REFERENCE TO RELATED APPLICATIONS

This application claims the benefit of Korean Patent Application No. 2008-0105965, filed on Oct. 28, 2008 in the Korean Intellectual Property Office, the disclosure of which is incorporated herein by reference.

BACKGROUND

1. Field

Embodiments of the present invention relate to a refrigerator having an improved door opening configuration.

2. Description of the Related Art

Generally, a refrigerator is an apparatus to store food at a low temperature, and includes a first storage compartment in which food is stored at a relatively low temperature, and a second storage compartment in which food is stored at a temperature higher than that of the first storage compartment.

The refrigerator includes a body internally defining storage compartments, such as the first and second storage compartments, doors provided at a front side of the body to open or close the respective storage compartments, and door handles provided at a front side of the respective doors.

A user may open or close the storage compartments by gripping the door handles provided at the front side of the respective doors.

SUMMARY

It is an aspect of the present invention to provide a refrigerator having an improved door opening configuration.

Additional aspects of the invention will be set forth in part in the description which follows and, in part, will be apparent from the description, or may be learned by practice of the embodiments of the invention.

In accordance with one aspect, a refrigerator includes a body in which a storage compartment is defined, a door hingedly coupled to the body and serving to open or close the storage compartment, and a door opening device to open the door, the refrigerator further including a shield provided at a front surface of the door and serving to cover the door opening device, and the door opening device is mounted in a grip part defined in any one of an upper surface of the door, a lower surface of the door and a side surface of the door opposite to a hinge shaft of the door, and the door opening device includes a pivoting member having a pivoting shaft extending in a longitudinal direction of the grip part, a press portion extending from the pivoting shaft outward of the door, and an operating portion extending from the pivoting shaft inward of the door, and a push unit to push the body when being pressed by the operating portion of the pivoting member.

The pivoting shaft may be arranged parallel to any adjacent one of an upper rim and a lower rim of the door.

The push unit may be pressed by the operating portion, thereby acting to push a sidewall of the body.

The pivoting shaft may have a length corresponding to a distance between opposite sidewalls of the body, and the operating portion may include a first operating portion and a second operating portion provided at both ends of the pivoting shaft. The door may include a first mount and a second mount provided at positions corresponding to the first operating portion and the second operating portion.

The door may be selectively hingedly coupled to one of opposite sides of the body, to enable selective leftward or rightward opening of the door, and the push unit may be selectively installed to the first mount or the second mount based on an opening or closing direction of the door.

The push unit may include a supporting portion to come into contact with the press portion, and a push rod bent from the supporting portion to extend toward a rear surface of the door, and the first mount and the second mount respectively may include a seating portion on which the supporting portion is seated, and a passage through which the push rod penetrates.

The door opening device may further include an elastic member having one end supported by the supporting portion of the push unit and the other end supported on the door, and each of the mounts may further include an elastic member receiving recess defined in the seating portion to receive the elastic member.

The refrigerator may further include a gasket provided at the rear side of the door along a door rim, and a distance between the push rod of the push unit and the gasket may be in the range of about 2 mm to about 10 mm.

The shield may be integrally formed with a front panel of the door.

The shield may be connected to be level with a front panel of the door without a difference in height.

The pivoting shaft may be arranged parallel to a door rim opposite to the hinge shaft of the door, and the push unit may be pressed by the operating portion of the pivoting member, thereby acting to push the body.

The grip part may be defined in a door cap provided at an upper side of the door.

In accordance with another aspect, a refrigerator includes a body in which a storage compartment is defined, a door hingedly coupled to the body and serving to open or close the storage compartment, and a door opening device to open the door, the refrigerator further including a shield provided at a front surface of the door and serving to cover the door opening device, and the door opening device is mounted in a grip part defined in any one of an upper surface and a lower surface of the door and includes a pivoting member having a pivoting shaft extending in a longitudinal direction of the grip part, a press portion extending from the pivoting shaft outward of the door, and an operating portion extending from the pivoting shaft inward of the door, and a push unit to push the body when being pressed by the operating portion of the pivoting member.

In accordance with another aspect, a refrigerator includes a first storage compartment and a second storage compartment provided in upper and lower sides of a body, a first storage compartment door and a second storage compartment door hingedly coupled, respectively, to the upper and lower sides of the body, to open or close the first storage compartment and the second storage compartment, a first grip part and a second grip part defined, respectively, in a lower surface of the first storage compartment door and an upper surface of the second storage compartment door, and a first door opening device and a second door opening device mounted, respectively, in the first grip part and the second grip part.

In accordance with another aspect, a refrigerator includes a body in which a storage compartment is defined, a door to open or close the storage compartment of the body, a door opening device including a pivoting member to be pivotally rotated by an opening force applied forward from the rear of the door by a user, and a push unit to slide rearward from the front of the door by the pivoting member so as to push the body, and a shield provided at the front of the door and serving to cover the door opening device.

The pivoting member may include a press portion to which an opening force is applied by a user, a pivoting shaft coupled to the press portion and arranged parallel to one of an upper rim of the door, a lower rim of the door and a side rim of the door opposite to a hinge shaft of the door, and an operating portion coupled to the pivoting shaft and adapted to transmit the user opening force applied to the press portion to the push unit.

The pivoting member may be installed to the door such that a pivoting shaft thereof is parallel to one of the upper rim and lower rim of the door, and the push unit may be selectively installed to one of opposite sides of the door and serves to push a sidewall of the body.

In accordance with a further aspect, a refrigerator includes a body in which a storage compartment is defined, a door to open or close the storage compartment of the body, a grip part defined in any one of an upper surface of the door, a lower surface of the door and a side surface of the door opposite to a hinge shaft of the door, a pivoting member pivotally rotatably installed in the grip part, and a push unit to push the body when being pressed by the pivoting member.

The pivoting member may include a pivoting shaft extending in a longitudinal direction of the grip part, a press portion extending from the pivoting shaft outward of the door, and an operating portion extending from the pivoting shaft inward of the door.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION OF EMBODIMENTS

Figure 1:
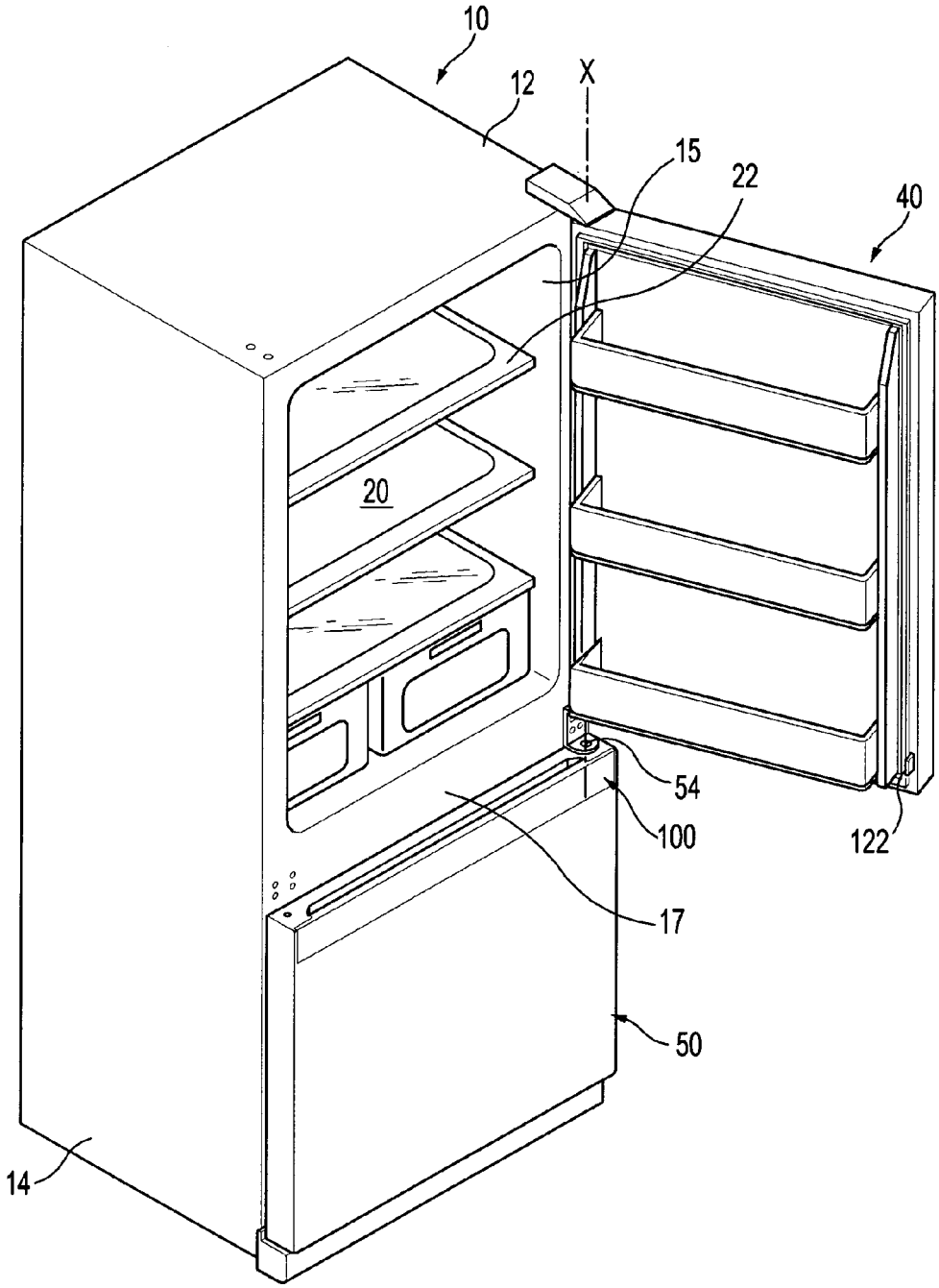
FIG. 1 is a perspective view illustrating an external appearance of a refrigerator according to one embodiment.

Reference will now be made in detail to the embodiments of the present invention, examples of which are illustrated in the accompanying drawings, wherein like reference numerals refer to the like elements throughout.

Figure 2:
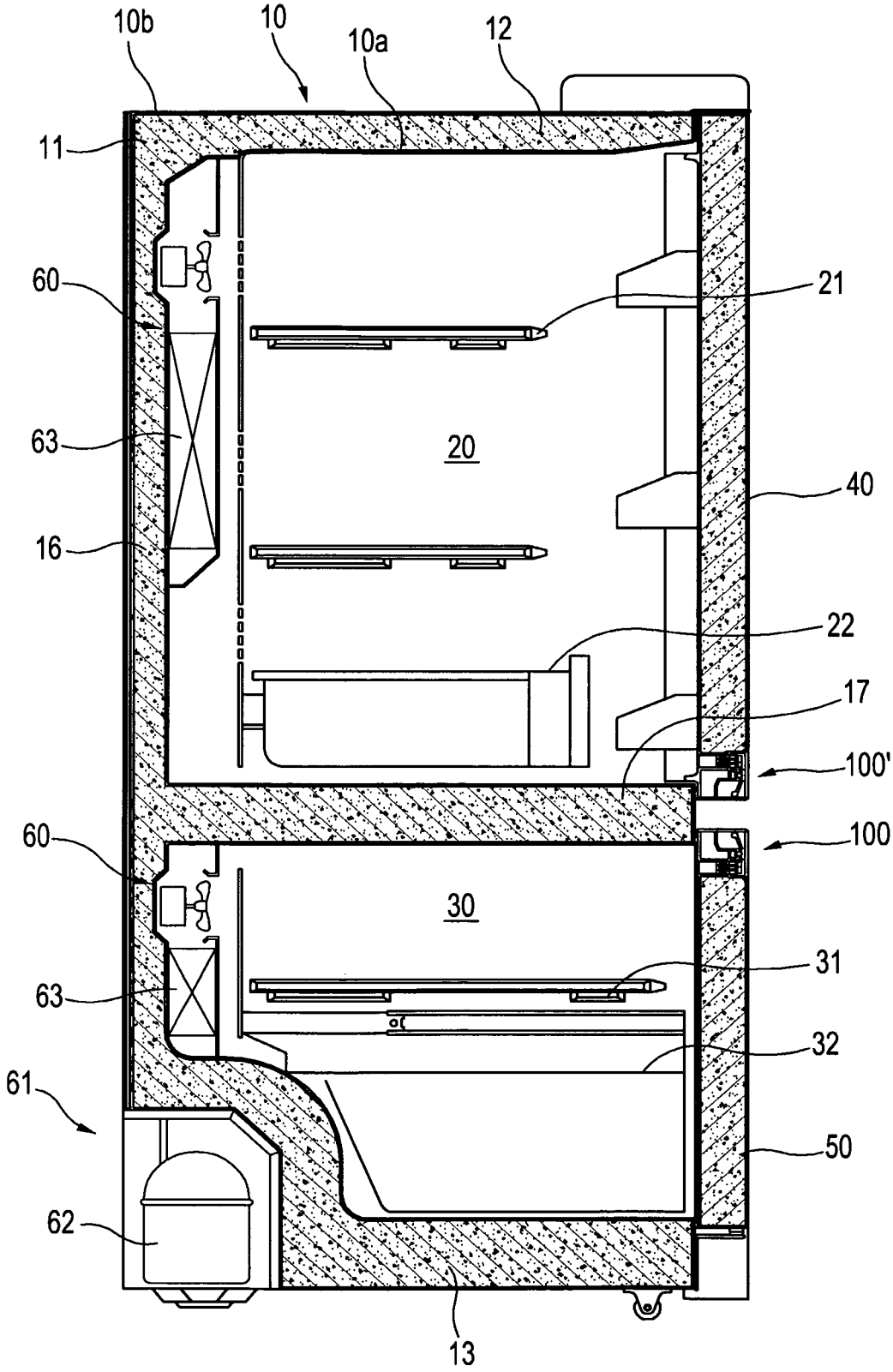
FIG. 2 is a side sectional view illustrating a configuration of the refrigerator according to the embodiment.

FIG. 1 is a perspective view illustrating an external appearance of a refrigerator according to one embodiment, and FIG. 2 is a side sectional view illustrating a configuration of the refrigerator according to the embodiment.

As shown, the refrigerator according to the present embodiment includes a body 10 in which a plurality of storage compartments 20 and 30 is defined separately, doors 40 and 50 provided at the front of the plurality of storage compartments 20 and 30 to open or close the respective storage compartments 20 and 30, cold air supply devices 60 provided in the respective storage compartments 20 and 30 and serving to supply cold air into the storage compartments 20 and 30, and a machine room 61 provided in a rear lower region of the body 10 to receive electric devices, such as a compressor 62, etc.

The refrigerator according to the present embodiment includes a refrigeration cycle comprised of the compressor 62, condenser (not shown), expander (not shown) and evaporator 63, to produce cold air to be discharged via the cold air supply devices 60.

The body 10 includes an inner shell 10*a* and an outer shell 10*b*. A foam material 11 for heat insulation is filled between the inner shell 10*a* and the outer shell 10*b* of the body 10. In this case, an external appearance of the body 10 is defined by an upper wall 12, a lower wall 13, a left sidewall 14, a right sidewall 15 and a rear wall 16. An intermediate partition 17 is further located in the body 10, to separate the storage compartments 20 and 30 from each other.

The storage compartments 20 and 30, separated from each other by the intermediate partition 17, include a first storage compartment 20 located above the partition 17, and a second storage compartment 30 located under the partition 17. The respective storage compartments 20 and 30 are provided with shelves 21 and 31 and receiving drawers 22 and 32, to assist fresh storage of food, etc.

The doors 40 and 50 include a first storage compartment door 40 and a second storage compartment door 50. The first and second storage compartment doors 40 and 50 are provided at the front side of the respective first and second storage compartments 20 and 30 and are hingedly coupled to the same lateral side of the body 10. The respective doors 40 and 50 are defined in several positions of an inner surface thereof with receiving spaces.

The refrigerator according to the present embodiment further includes door opening devices 100 and 100' provided at the first storage compartment door 40 and second storage compartment door 50 and serving to facilitate easy opening of the respective doors 40 and 50. For convenience, the following description will be concentrated on the door opening device 100 provided at an upper side of the second storage compartment door 50. The door opening device 100' provided at a lower side of the first storage compartment door 40 is symmetrical to the door opening device 100 provided at the upper side of the second storage compartment door 50 and thus a description thereof will be omitted. Accordingly, if there is no special mention, the following description may be equally applicable to the door opening device 100' provided at the lower side of the first storage compartment door 40.

Figure 3A:
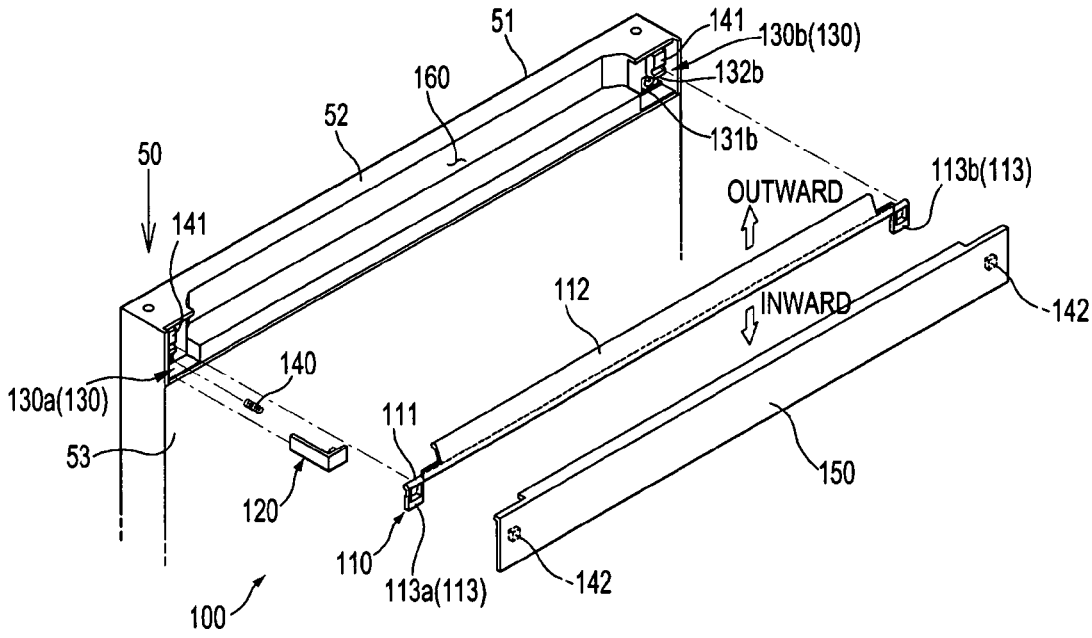
FIGS. 3A and 3B are perspective views illustrating a door opening device of the refrigerator according to the embodiment.
Figure 3B:
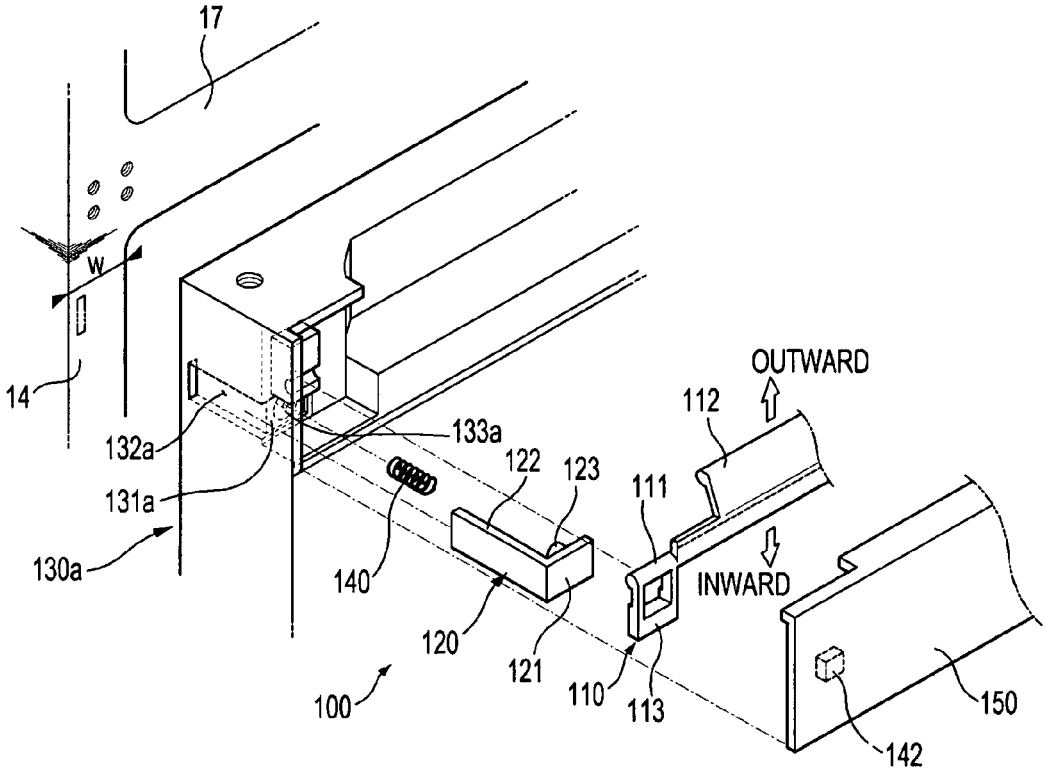
Figure 3C:
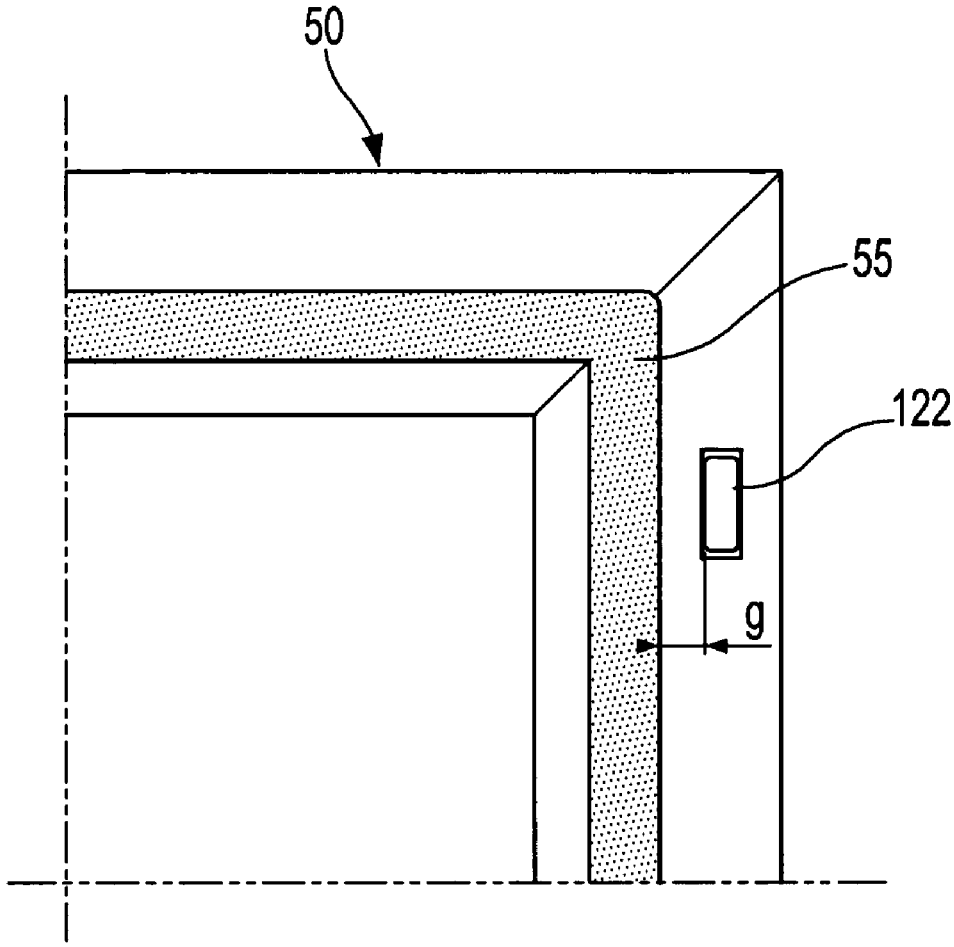
FIG. 3C is a partial enlarged view illustrating a rear surface of a second storage compartment door according to the embodiment.

FIGS. 3A and 3B are perspective views illustrating the door opening device of the refrigerator according to the embodiment, and FIG. 3C is a partial enlarged view illustrating a rear surface of the second storage compartment door according to the embodiment.

As shown, the refrigerator of the present embodiment includes the door opening device 100 provided at the upper side of the second storage compartment door 50. The door opening device 100 includes a pivoting member 110 pivotally rotatably installed on the upper side of the second storage compartment door 50, a push unit 120 to be slidably moved by the pivoting member 110 so as to push the body 10, a mount 130 defined in the second storage compartment door 50 to receive the push unit 120, and an elastic member 140 to elastically bias the push unit 120 toward a front surface of the door 50.

The pivoting member 110 includes a pivoting shaft 111 arranged parallel to an adjacent rim of the door, i.e. an upper rim 51 of the second storage compartment door 50, a press portion 112 extending from the pivoting shaft 111 outward of the second storage compartment door 50, and an operating portion 113 extending from the pivoting shaft 111 inward of the second storage compartment door 50. For reference, a pivoting member 110' of the door opening device 100' provided at the lower side of the first storage compartment door 40 is arranged such that a pivoting shaft 111' thereof is parallel to a lower rim 41 of the first storage compartment door 40 (see FIG. 6A).

The pivoting shaft 111 is pivotally rotatably supported by supporting recesses 141 defined in the second storage compartment door 50 and supporting recesses 142 defined in a rear surface of a shield 150 which will be described hereinafter.

The operating portion 113 includes a first operating portion 113*a* and a second operating portion 113*b* provided at both ends of the pivoting shaft 111. The press portion 112 is located between the first operating portion 113*a* and the second operating portion 113*b*. As shown, the pivoting shaft 111 has a length corresponding to a distance between opposite sidewalls of the body 10. The first operating portion 113*a* and second operating portion 113*b* may be arranged at positions corresponding to opposite sidewalls of the body 10, i.e. the left sidewall 14 and right sidewall 15. As will be described hereinafter, the door opening device of the present embodiment may be also applicable to a reversible door.

The push unit 120 includes a supporting portion 121 to come into contact with the press portion 112 of the pivoting member 110, and a push rod 122 bent at a right angle from the supporting portion 121 to extend toward a rear surface of the second storage compartment door 50. When the pivoting member 110 is manually pivotally rotated, the operating portion 113 of the pivoting member 110 presses the supporting portion 121 against an elastic force of the elastic member 140, and the push rod 122 integrally formed with the supporting portion 121 slides rearward of the second storage compartment door 50 thus acting to push the left sidewall 14 of the body 10. Reference numeral 123 indicates a spring support on which one end of the elastic member 40 is supported.

The push rod 122 is spaced apart from a gasket 55 installed at the rear surface of the door 50 by a predetermined distance g (see FIG. 3C), and the predetermined distance g may be in the range of about 2 mm to about 10 mm. If the distance g between the gasket 55 and the push rod 122 is less than 2 mm, there is a high possibility of interference between the push rod 122 and the gasket 55 upon sliding movement of the push unit 120. If the distance g between the gasket 55 and the push rod 122 is more than 10 mm, this may excessively increase a width w of the sidewall 14 in contact with the gasket 55 and push rod 122.

The mount 130 includes a first mount 130*a* and a second mount 130*b* provided at upper opposite ends of the second storage compartment door 50 to correspond to the first operating portion 113*a* and second operating portion 113*b* of the pivoting member 110. As will be described hereinafter, the push unit 120 may be selectively mounted to the first mount 130*a* or the second mount 130*b* based on an opening or closing direction of the door.

The mounts 130*a* and 130*b* respectively include seating portions 131*a* and 131*b*, on which the supporting portion 121 of the push unit 120 is seated, passages 132*a* and 132*b* to guide the push rod 122, and elastic member receiving recesses 133*a* and 133*b* defined in the seating portions 131*a* and 131*b*, in which the elastic member 140 to elastically support the push unit 120 is received.

The refrigerator of the present embodiment further includes the shield 150 provided at the front of the door opening device 100. The shield 150 and a door frame 52 define a grip part 160 longitudinally defined in an upper surface of the second storage compartment door 50. The door opening device 100 is arranged in the grip part 160 and both the door opening device 100 and the grip part 160 are invisible from the front of the refrigerator. Of course, similar to a conventional manner, a grip part may be defined in a door cap plane, and the door opening device may be installed to the grip part. In this case, it will be understood that the frame 52 and shield 150 of the present embodiment correspond to a door cap.

Figure 4A:
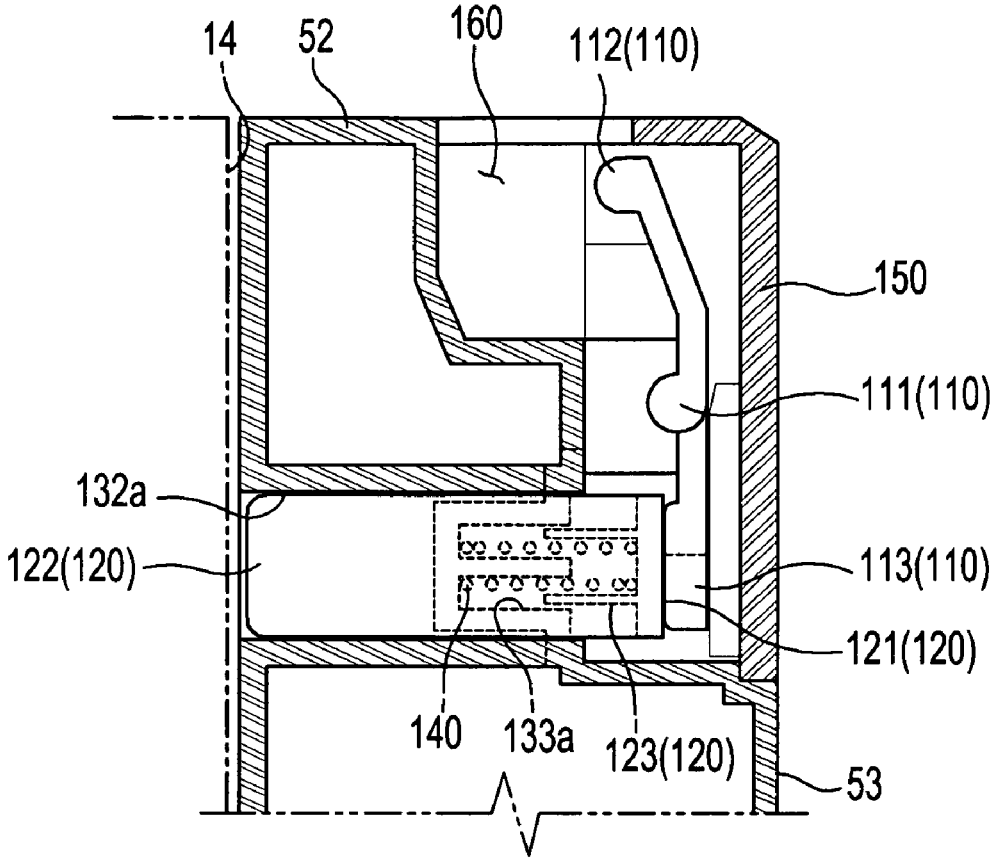
FIGS. 4A and 4B are sectional views illustrating an operation of the door opening device according to the embodiment.
Figure 4B:
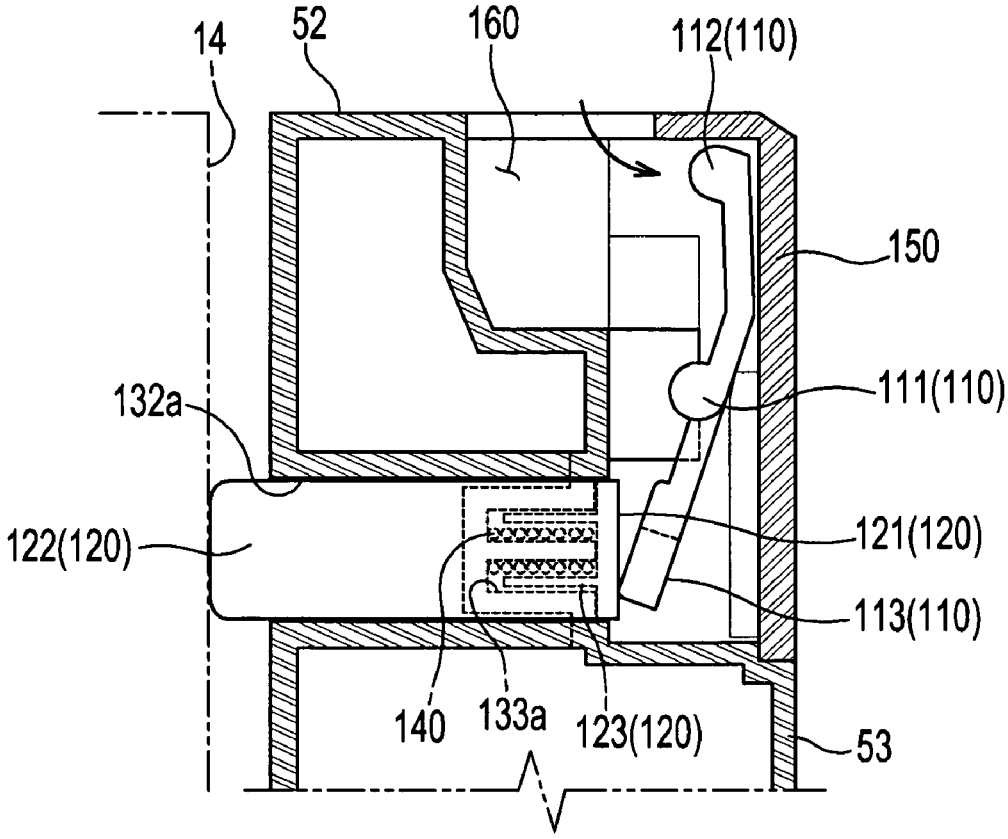

The pivoting member 110 of the door opening device 100 may be completely inserted in the grip part 160, to allow the door opening device 100 to be completely invisible from the front of the refrigerator (see FIGS. 4A and 4B). However, a part of the pivoting member 110, more particularly, a part of the press portion 112 may protrude upward from the shield 150 as necessary.

Although the shield 150 may be level with a front panel 53 of the second storage compartment door 50 without a difference in height in consideration of an aesthetic outer appearance and safety, there is no special limit in connecting methods between the shield 150 and the front panel 53 and configurations thereof.

For reference, although the shield 150 of the present embodiment is fabricated separately from the front panel 53 of the second storage compartment door 50, the shield 150 may be integrally formed with the front panel 53 of the second storage compartment door 50 so as to constitute a part of the front panel 53. Of course, the shield 150 may be integrally formed with the frame 52. In this case, the pivoting member 110 and push rod 122 may have a slight change in installation configuration.

Figure 4C:
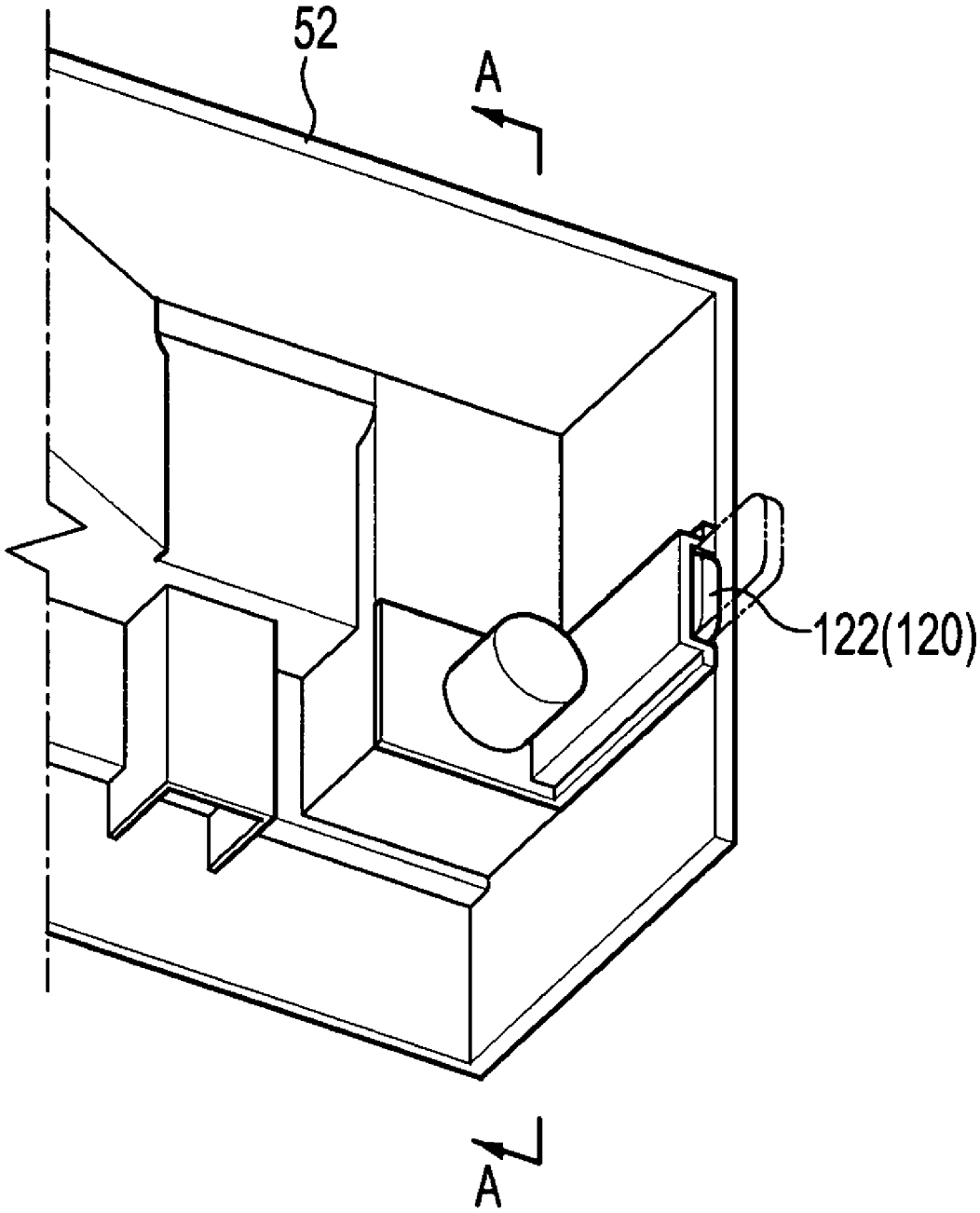
FIG. 4C is a rear perspective view of the door opening device according to the embodiment.
Figure 4D:
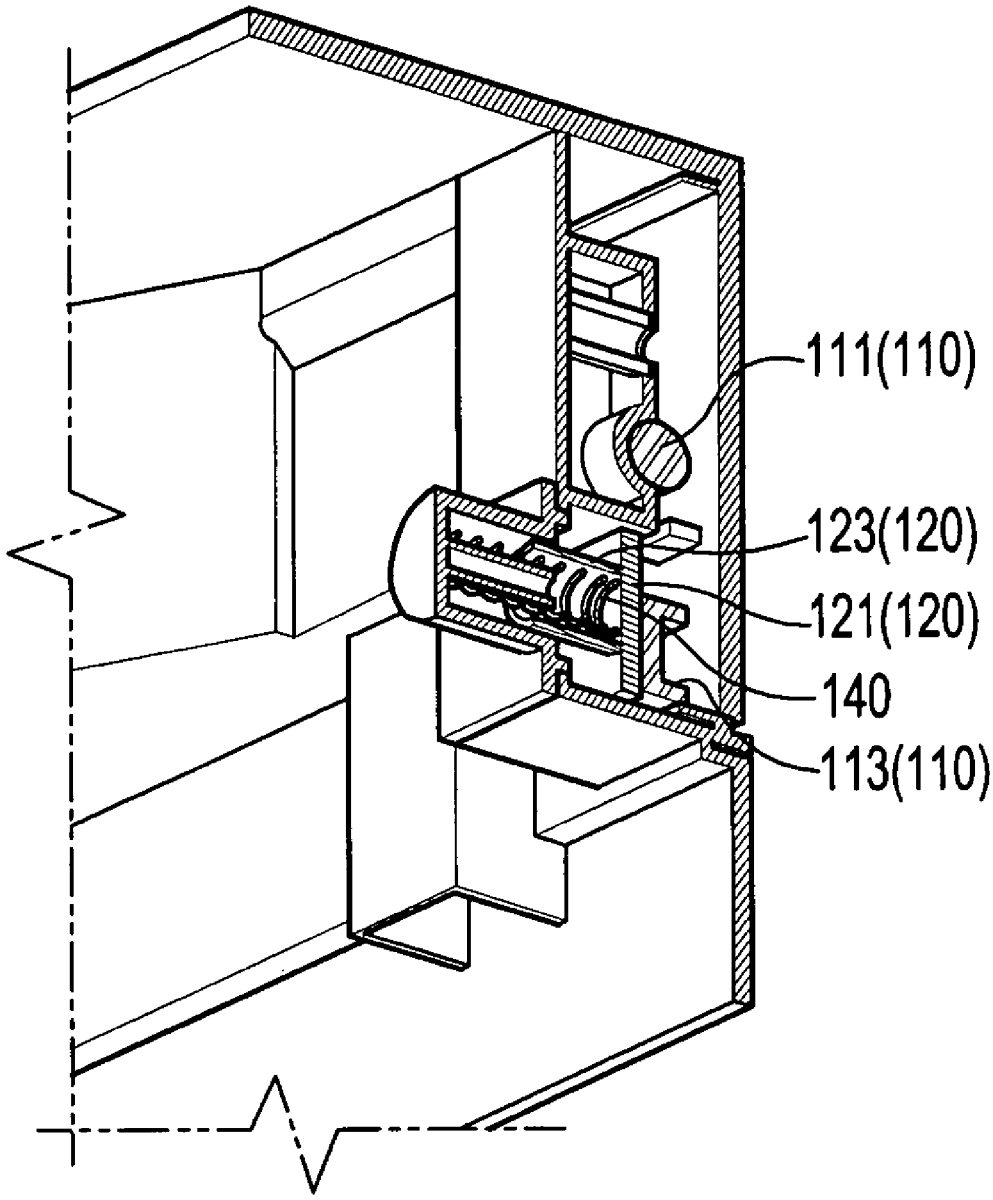
FIG. 4D is a sectional view taken along the line A-A of FIG. 4C.

FIGS. 4A and 4B are sectional views illustrating an operation of the door opening device according to the embodiment, FIG. 4C is a rear perspective view of the door opening device according to the embodiment, and FIG. 4D is a sectional view taken along the line A-A of FIG. 4C.

As shown, if the press portion 112 of the pivoting member 110 is manually pressed forward, the pivoting member 110 is rotated about the pivoting shaft 111. Rotation of the pivoting shaft 111 causes the operating portion 113 to press the supporting portion 121 of the push unit 120 against the elastic force of the elastic member 140. As the pressed push unit 120 slides rearward of the second storage compartment door 50, the push rod 122 of the push unit 120 pushes the sidewall 14 as a free sidewall of the body, i.e. a sidewall opposite to the hinge shaft 54 of the second storage compartment door 50 (see FIG. 1).

Accordingly, the refrigerator of the present embodiment enables door opening with a slight force based on leverage. In particular, the push rod 122 of the present embodiment pushes a free sidewall of the body 10 farthest from a pivoting center x of the door, i.e. the left sidewall 14 (see FIG. 1) thus further reducing a required door opening force.

Figure 5:
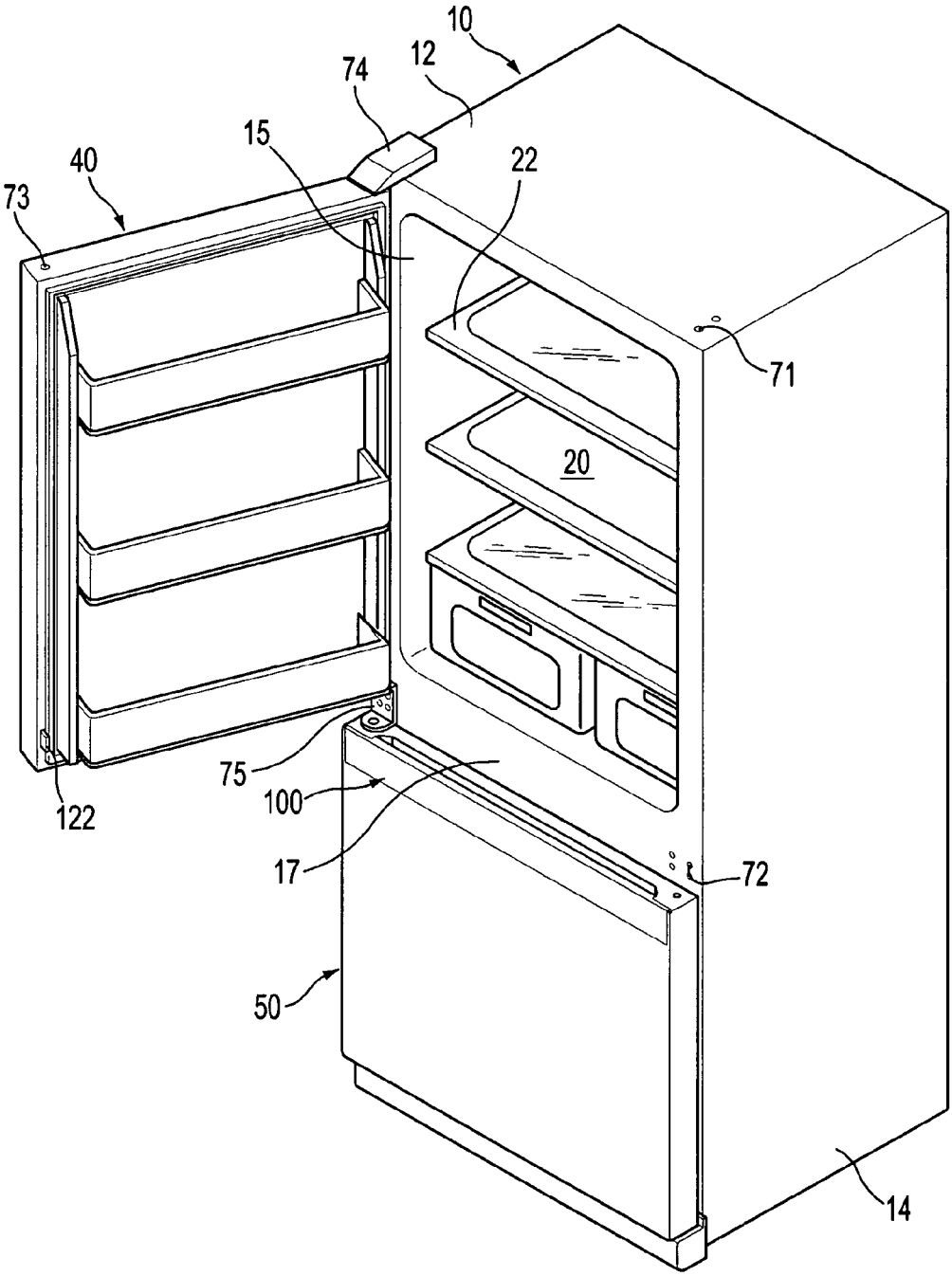
FIG. 5 is a perspective view of the refrigerator according to the embodiment, illustrating a door opening or closing direction different from that of FIG. 1.
Figure 6A:
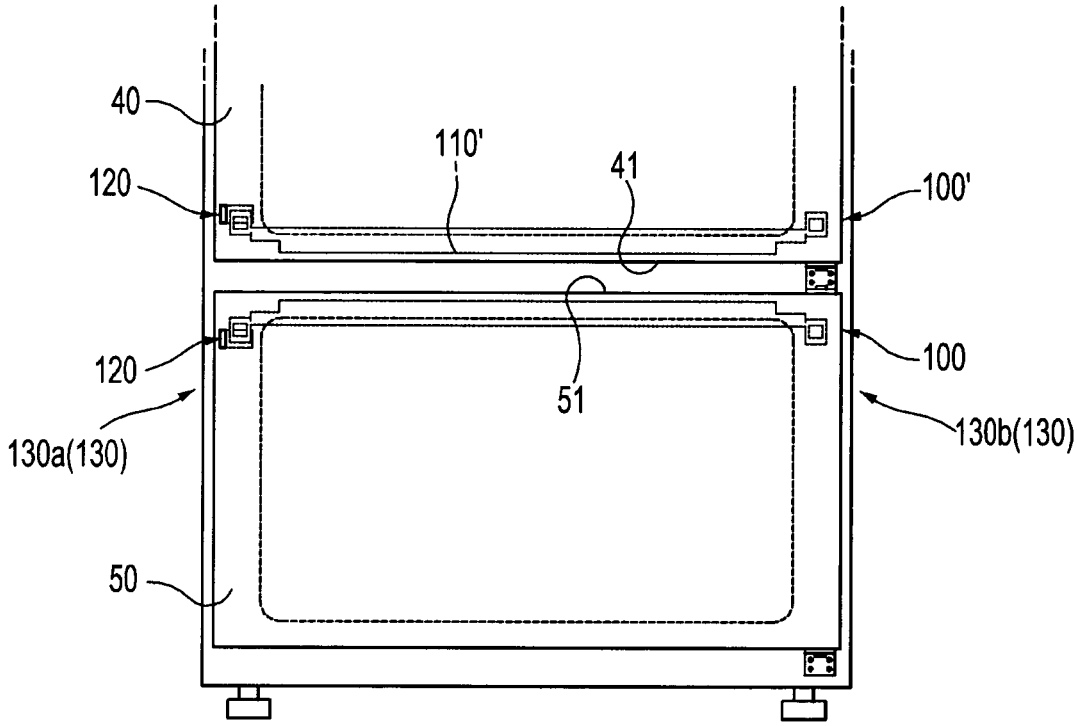
FIGS. 6A and 6B are front views illustrating an installation position of a push unit depending on a door opening or closing direction.
Figure 6B:
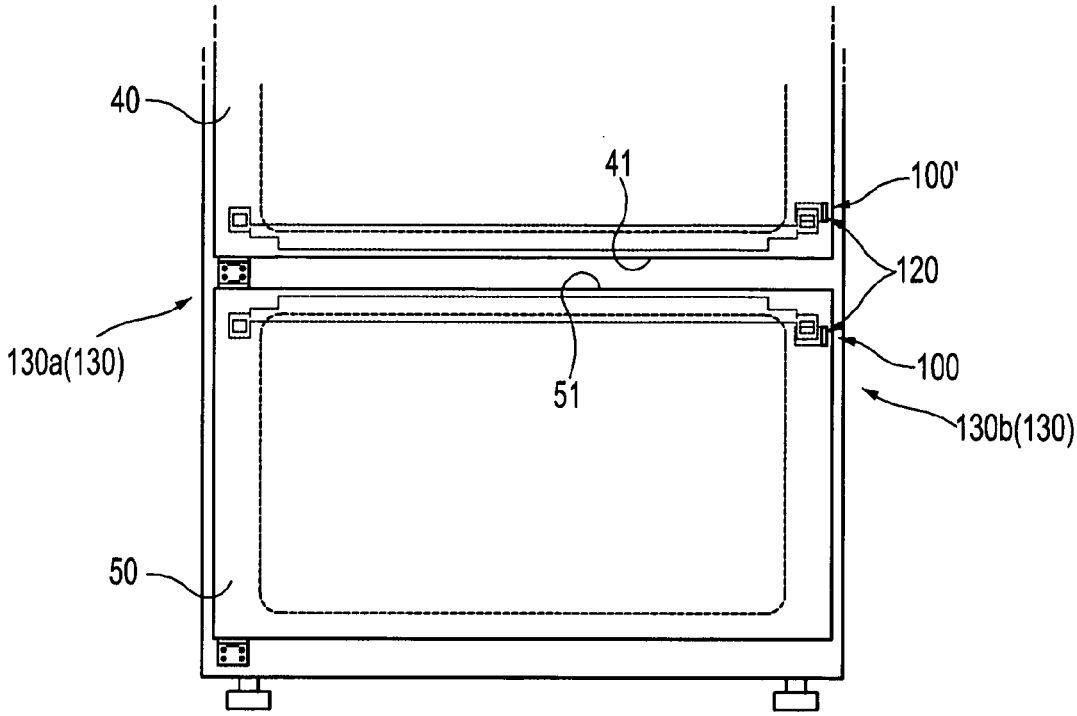

FIG. 5 is a perspective view of the refrigerator according to the embodiment, illustrating a door opening or closing direction different from that of FIG. 1, and FIGS. 6A and 6B are front views illustrating an installation position of the push unit depending on a door opening or closing direction.

As shown in FIG. 5, the door of the present embodiment is a reversible door to optionally select'a door opening or closing direction. Accordingly, the user may hingedly couple the door to the left sidewall or the right sidewall based on a wanted opening or closing direction.

In the refrigerator of the present embodiment, simultaneously with changing a door opening or closing direction, the configuration of the door opening device also may be easily changed. More specifically, the refrigerator of the present embodiment includes the first mount 130*a* and second mount 130*b* at opposite sides of the second storage compartment door 50 (see FIG. 3) and therefore, the user may selectively install the push unit 120 to the first mount 130*a* or the second mount 130*b* based on an opening or closing direction of the second storage compartment door 50. Accordingly, even in the case of the reversible door, effective use of the door opening device according to the present embodiment may be assured via appropriate change in the installation position of the push unit. That is, regardless of an opening or closing direction, the push rod 120 of the present embodiment may be arranged to push a sidewall farthest from a pivoting center of the door.

For reference, the refrigerator shown in FIG. 6A is a left opening type refrigerator as shown in FIG. 1 and in this case, the push unit 120 will be located at a left upper end of the second storage compartment door 50. On the other hand, the refrigerator shown in FIG. 6B is a right opening type refrigerator as shown in FIG. 5 and in this case, the push unit 120 will be located at a right upper end of the second storage compartment door 50. In FIG. 5, reference numerals 71 and 72 indicate coupling holes for hinge brackets 74 and 75 for coupling of a left opening/closing type hinge, and reference numeral 73 indicates a coupling hole for a hinge shaft (not shown) for coupling of the left opening/closing type refrigerator.

In the refrigerator of the present embodiment, as described above, no visible handle is used and also, any recess and door opening device for easy opening of the door are completely invisible from the front of the refrigerator, resulting in enhanced aesthetic value of the entire refrigerator. That is, as compared to a conventional refrigerator wherein a door handle or door opening device is located at a front surface of a door, the refrigerator according to the present embodiment allows the door opening device to be invisible from the front of the refrigerator thus having the effect of improving the external appearance of the refrigerator.

Further, in the case where a handle is attached to the front surface of the door to thereby be revealed to the front of the door, the handle causes serious inconvenience in packaging and transportation of the refrigerator. However, the refrigerator of the present embodiment provides a level door front surface thus achieving considerably easy packaging and transportation of the refrigerator. That is, the refrigerator of the present embodiment may improve the distribution efficiency of the refrigerator.

Not attaching the door handle or the door opening device to the front surface of the door, furthermore, may provide not only improved space utility with relation to the surrounding space of the refrigerator, but also reduction in material costs and assembly costs required to attach the handle.

In the refrigerator of the present embodiment, a door opening force is applied to a sidewall farthest from a pivoting center of the door. This configuration allows even a very heavy door to be opened with a slight force, resulting in enhanced use convenience.

In addition, since the refrigerator of the present embodiment assures easy change in the installation position of the push rod of the door opening device, the door opening device may be effectively used even when a door opening or closing direction is changed. In other words, the user may easily change the position of the push rod so as to push a sidewall farthest from a pivoting center of the door based on a door opening or closing direction.

Figure 7A:
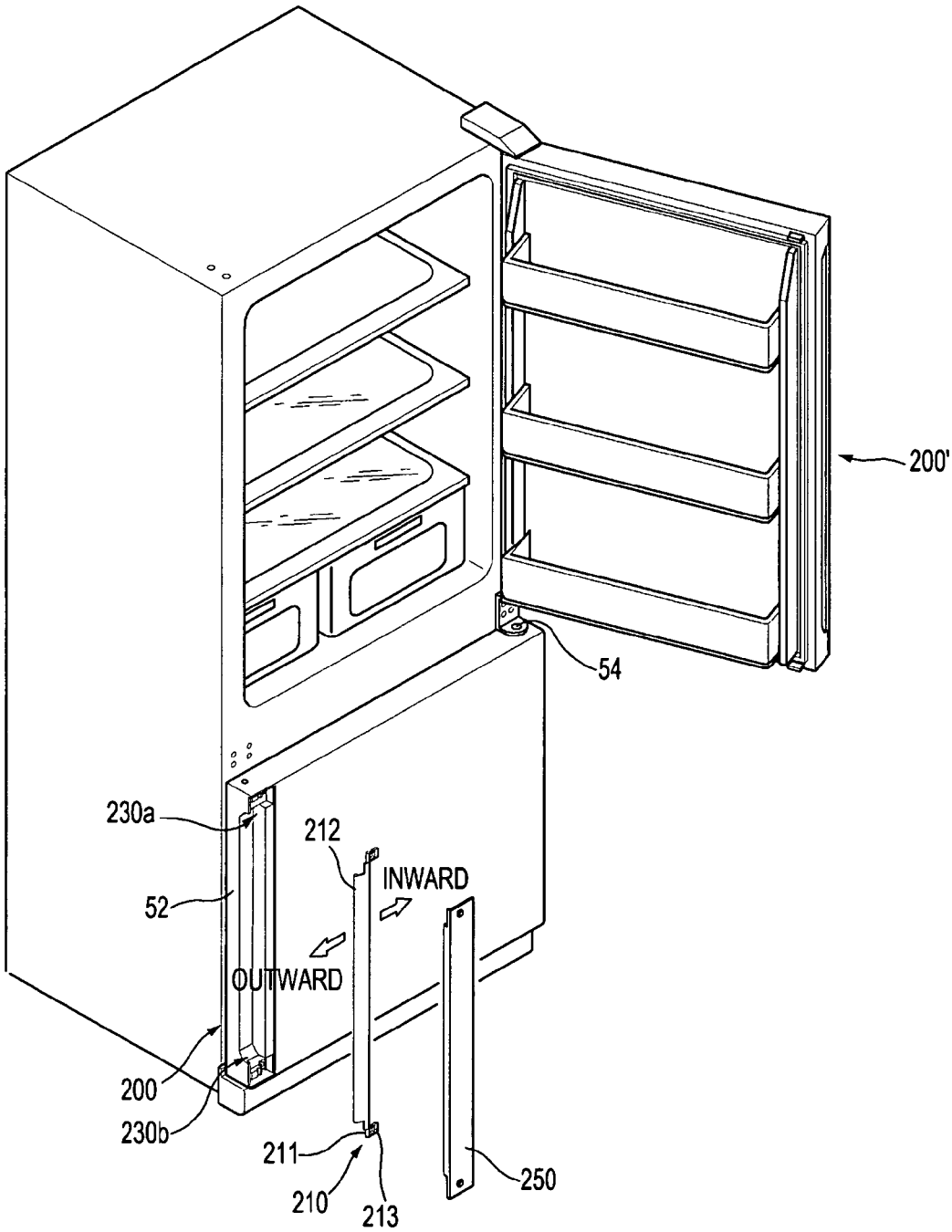
FIGS. 7A and 7B are, respectively, a perspective view and a front view illustrating a refrigerator according to another embodiment.
Figure 7B:
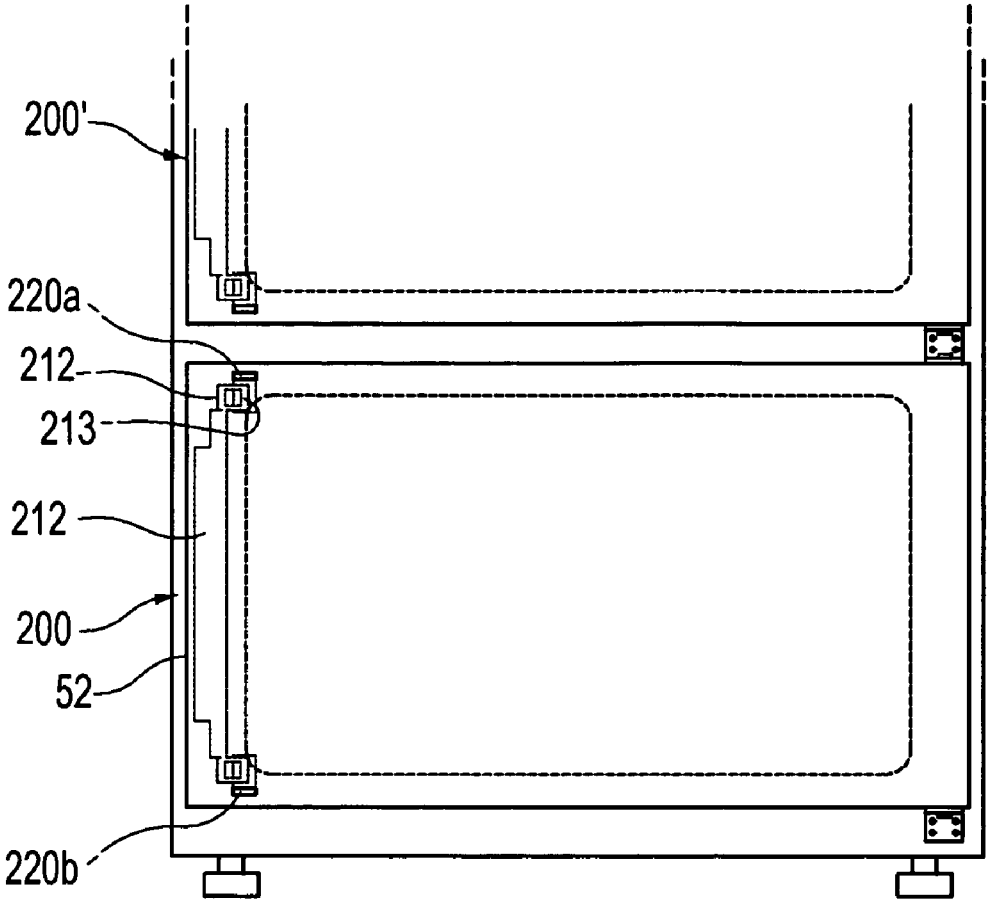

FIGS. 7A and 7B are, respectively, a perspective view and a front view illustrating a refrigerator according to another embodiment. For reference, the same elements and configurations as those of the previously described embodiment are designated by the same reference numerals, and a description thereof will be omitted.

As shown, door opening devices 200 and 200' of the present embodiment are located at free ends of the first storage compartment door 40 and second storage compartment door 50, i.e. at an opposite side of the hinge shaft 54.

Specifically, a pivoting member 210 of the door opening device 200 provided at the free end of the second storage compartment door 50 according to the present embodiment is arranged such that a pivoting shaft 211 thereof is parallel to a free end rim of the door 50. In this case, a press portion 212 of the pivoting member 210 extends from the pivoting shaft 211 outward of the second storage compartment door 50, and an operating portion 213 extends from the pivoting shaft 211 inward of the second storage compartment door 50. A shield 250 to cover the door opening device 200 is provided at the front of the door opening device 200. Also, a first mount 230*a* and a second mount 230*b* are provided at upper and lower ends of the free end rim of the second storage compartment door 50. Accordingly, in the present embodiment, a pair of the push units 120 is installed to both the first mount 230*a* and the second mount 230*b*, respectively.

Various other modifications of the above-described embodiments may be naturally possible. For example, there is no limit in the number of the storage compartments defined in the body. Also, the refrigerator according to the embodiments may naturally be applied to a double-door type refrigerator.

In addition, the door opening device described herein is an exemplary door opening device, a front side of which is covered by a shield, and there is no limit in the configuration of the door opening device.

As is apparent from the above description, a refrigerator according to the embodiments has the following technical advantages.

First, a grip part used to open or close a door and a door opening device is invisible from the front of the refrigerator, resulting in an improved outer appearance of the refrigerator.

Secondly, the refrigerator has no handle attached to, for example, a front surface of a door, and this has the effect of reducing material costs and assembly costs. The elimination of the handle protruding forward from the door may be advantageous in view of packaging and transportation of the refrigerator thus resulting in enhanced distribution efficiency.

Thirdly, provision of the door opening device assures easy door opening with a slight force and consequently, enhancement of user convenience. In particular, the door opening device is adapted to transmit an opening force to a sidewall of the refrigerator farthest from a pivoting center of the door thus enabling door opening with a further reduced force.

Fourthly, the door opening device according to the embodiments is applicable to a reversible door. Specifically, the configuration of the door opening device may be changed based on a door opening direction for the purpose of effective door opening, and this configuration change may be simply accomplished even by a user.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a body in which a storage compartment is defined;

a door hingedly coupled to the body and serving to open or close the storage compartment;

a door opening device to open the door;

a shield provided at a front surface of the door and serving to cover the door opening device, wherein the door opening device is mounted in a grip part defined in any one of an upper surface of the door, a lower surface of the door and a side surface of the door opposite to a hinge shaft of the door, and wherein the door opening device includes a pivoting member having a pivoting shaft extending in a longitudinal direction of the grip part, a press portion extending from the pivoting shaft outward of the door, and an operating portion extending from the pivoting shaft inward of the door; and a push unit to push the body when being pressed by the operating portion of the pivoting member, wherein the pivoting shaft has a length corresponding to a length of one side of the door where the grip part is formed, the operating portion includes first and second operating portions provided at both ends of the pivoting shaft, and the door includes first and second mounts provided at positions corresponding to the first and second operating portions, respectively.

2. The refrigerator according to claim 1, wherein the pivoting shaft is arranged parallel to any adjacent one of an upper rim and a lower rim of the door.

3. The refrigerator according to claim 2, wherein the push unit is pressed by the operating portion, thereby acting to push a sidewall of the body.

4. The refrigerator according to claim 1, wherein the pivoting shaft has a length corresponding to a distance between opposite sidewalls of the body.

5. The refrigerator according to claim 4, wherein the door is selectively hingedly coupled to one of opposite sides of the body, to enable selective leftward or rightward opening of the door, and wherein the push unit is selectively installed to the first mount or the second mount based on an opening or closing direction of the door.

6. The refrigerator according to claim 1, wherein the push unit includes a supporting portion to come into contact with the press portion, and a push rod bent from the supporting portion to extend toward a rear surface of the door, and wherein the first mount and the second mount respectively includes a seating portion on which the supporting portion is seated, and a passage through which the push rod penetrates.

7. The refrigerator according to claim 6, wherein the door opening device further includes an elastic member having one end supported by the supporting portion of the push unit and the other end supported on the door, and wherein each of the mounts further includes an elastic member receiving recess defined in the seating portion to receive the elastic member.

8. The refrigerator according to claim 6, further comprising a gasket provided at the rear side of the door along a door rim, wherein a distance between the push rod of the push unit and the gasket is in the range of about 2 mm to about 10 mm.

9. The refrigerator according to claim 1, wherein the shield is integrally formed with a front panel of the door.

10. The refrigerator according to claim 1, wherein the shield is connected to be level with a front panel of the door without a difference in height.

11. The refrigerator according to claim 1, herein the pivoting shaft is arranged parallel to a door rim opposite to the hinge shaft of the door, and wherein the push unit is pressed by the operating portion of the pivoting member, thereby acting to push the body.

12. The refrigerator according to claim 1, wherein the grip part is defined in a door cap provided at an upper side of the door.

13. A refrigerator comprising:

a body in which a storage compartment is defined;

a door hingedly coupled to the body and serving to open or close the storage compartment;

a door opening device to open the door; and a shield provided at a front surface of the door and serving to cover the door opening device, wherein the door opening device is mounted in a grip part defined in any one of an upper surface and a lower surface of the door, and includes a pivoting member having a pivoting shaft extending in a longitudinal direction of the grip part and having a length corresponding to a distance between opposite sidewalls of the body, a press portion extending from the pivoting shaft outward of the door, and an operating portion extending from the pivoting shaft inward of the door; and a push unit to push against the body when being pressed by the operating portion of the pivoting member wherein the operating portion includes a first operating portion and a second operating portion provided at both ends of the pivoting shaft, and the door includes a first mount and a second mount provided at positions corresponding to the first operating portion and second operating portions.

14. A refrigerator comprising:

a body in which a storage compartment is defined;

a door hingedly coupled to the body and serving to open or close the storage compartment; and a door opening device to open the door, wherein the door opening device is mounted in a grip part defined in any one of an upper surface and a lower surface of the door, and includes a pivoting member having a pivoting shaft extending in a longitudinal direction of the grip part and having a length corresponding to a distance between opposite sidewalls of the body, a press portion extending from the pivoting shaft outward of the door, and an operating portion extending from the pivoting shaft inward of the door; and a push unit to push against the body when being pressed by the operating portion of the pivoting member, and the door is hingedly coupled to one of both sides of the body and the push unit pushes the other side of the body opposite to a hinge shaft of the door wherein the operating portion includes a first operating portion and a second operating portion provided at both ends of the pivoting shaft, and the door includes a first mount and a second mount provided at positions corresponding to the first operating portion and second operating portions.

15. A refrigerator comprising:

a body in which a storage compartment is defined;

a door to open or close the storage compartment of the body;

a grip part defined in any one of an upper peripheral surface, a lower peripheral surface and a side peripheral surface of the door opposite to a hinge shaft of the door, in which the grip part is recessed inward at one of the upper peripheral surface, the lower peripheral surface and the side peripheral surface of the door such that both side ends of the grip part are positioned adjacent to both side ends of one of the upper peripheral surface, the lower peripheral surface and the side peripheral surface of the door;

a pivoting member wherein the operating portion includes a first operating portion and a second operating portion provided at both ends of the pivoting shaft, and the door includes a first mount and a second mount provided at positions corresponding to the first operating portion and second operating portions pivotally rotatably installed in the grip part and provided with a pivoting shaft having a length corresponding to a distance between both side ends of one of the upper peripheral surface, the lower peripheral surface and the side peripheral surface of the door; and a push unit to push against the body when being pressed by the pivoting member.

16. The refrigerator according to claim 15, further comprising a shield provided at a front of the door to form one side of the grip part and serving to cover the door opening device.

* * * * *

UNITED STATES PATENT AND TRADEMARK OFFICE

CERTIFICATE OF CORRECTION

PATENT NO. : 7,984,955 B2
APPLICATION NO. : 12/585298
DATED : July 26, 2011
INVENTOR(S) : Sang Gyu Jung et al.

It is certified that error appears in the above-identified patent and that said Letters Patent is hereby corrected as shown below:

Column 10, Line 15, In Claim 11, delete “herein” and insert -- wherein --, therefor.

Column 10, Line 40, In Claim 13, delete “member” and insert -- member, --, therefor.

Column 10, Line 66, In Claim 14, delete “door” and insert -- door, --, therefor.

Column 12, Line 1, In Claim 15, delete “member” and insert -- member, --, therefor.

Signed and Sealed this
Fourteenth Day of February, 2012

David J. Kappos

David J. Kappos
*Director of the United States Patent and Trademark Office*